US005586858A

United States Patent [19]

Tuckey

[11] Patent Number: 5,586,858

[45] Date of Patent: Dec. 24, 1996

[54] REGENERATIVE FUEL PUMP

[75] Inventor: Charles H. Tuckey, Cass City, Mich.

[73] Assignee: Walbro Corporation, Cass City, Mich.

[21] Appl. No.: 418,666

[22] Filed: Apr. 7, 1995

[51] Int. Cl.[6] ..... F04D 5/00

[52] U.S. Cl. ..... 415/55.1

[58] Field of Search ..... 415/55.1, 55.2, 415/55.3

[56] References Cited

U.S. PATENT DOCUMENTS

| | | | |
|---|---|---|---|
| 4,854,830 | 8/1989 | Kozawa et al. | 415/55.1 X |
| 5,160,249 | 11/1992 | Iwai et al. | 415/55.2 X |
| 5,221,178 | 6/1993 | Yoshioka et al. | 415/55.1 |
| 5,257,916 | 11/1993 | Tuckey | 417/423.3 |
| 5,338,165 | 8/1994 | Brockner et al. | 415/55.1 |
| 5,401,147 | 3/1995 | Yu | 415/55.1 |

*Primary Examiner*—Edward K. Look

*Assistant Examiner*—Michael S. Lee

*Attorney, Agent, or Firm*—Barnes, Kisselle, Raisch, Choate, Whittemore & Hulbert

[57] ABSTRACT

An electric-motor fuel pump that includes a housing with a fuel inlet and a fuel outlet, and an electric motor with a rotor responsive to application of electrical power for rotating within the housing. A pump mechanism includes an impeller coupled to the rotor for corotation with the rotor and having a periphery with a circumferential array of impeller vanes. A pair of plates oppose the sides of the impeller and a split ring surrounds the periphery of the impeller to form an arcuate pumping channel around the periphery of the impeller. Inlet and outlet ports at opposed ends of the pumping channel are operatively coupled to the inlet and outlet in the pump housing. Channels extend radially inwardly from the pockets in each side face of the impeller, and are interconnected by through-passages that extend through the impeller. A vapor vent is disposed in one of the side plates for sequential registry with the impeller through-openings for venting vapor from the pumping channel.

16 Claims, 2 Drawing Sheets

REGENERATIVE FUEL PUMP

The present invention is directed to electric-motor fuel pumps for automotive engine and like applications, and more particularly to a regenerative fuel pump and method of manufacture.

BACKGROUND AND OBJECTS OF THE INVENTION

Electric-motor regenerative pumps have heretofore been proposed and employed in automotive engine fuel delivery systems. Pumps of this character typically include a housing adapted to be immersed in a fuel supply tank with an inlet for drawing liquid fuel from the surrounding tank and an outlet for feeding fuel under pressure to the engine. The electric motor includes a rotor mounted for rotation within the housing and connected to a source of electrical power for driving the rotor about its axis of rotation. An impeller is coupled to the rotor for corotation with the rotor, and has a circumferential array of vanes about the periphery of the impeller. An arcuate pumping channel, with an inlet port and an outlet port at opposed ends, surrounds the impeller periphery for developing fuel pressure through a vortex-like action on the liquid fuel between the Dockets formed by the impeller vanes and the surrounding channel. One example of a fuel pump of this type is illustrated in U.S. Pat. No. 5,257,916.

A general object of the present invention is to provide an electric-motor regenerative fuel pump of the described character that achieves improved venting of fuel vapors and thereby helps reduce vapor lock and stall at the engine, and/or that provides improved fuel transition at the inlet and outlet ports of the pump to improve pumping efficiency and reduce noise. Another object of the present invention is to provide an improved and economical fuel pump of the described character and method of manufacturing the same.

SUMMARY OF THE INVENTION

An electric-motor regenerative fuel pump in accordance with the present invention includes a housing having a fuel inlet and a fuel outlet, and an electric motor with a rotor responsive to application of electrical power for rotation within the housing. A pump mechanism includes an impeller coupled to the rotor for corotation with the rotor, and a circumferential array of vanes extending around the periphery of the impeller. An arcuate pumping channel surrounds the impeller periphery between inlet and outlet ports that are operatively coupled to the fuel inlet and outlet of the housing for delivering fuel under pressure to the housing outlet. In accordance with a first aspect of the present invention, the impeller vanes comprise a circumferential array of axially facing pockets on each opposed axial side face of the rotor, a channel extending radially inwardly from each pocket on each axial side face of the rotor, and a passage extending through the impeller radially inwardly of each pair of pockets interconnecting the inner ends of the associated channels. A vent passage in the pump mechanism sequentially registers with the passages in the impeller as the impeller rotates to vent vapor from within the impeller pockets and the pumping channel. Centrifugal forces on liquid fuel generated by the vortex-like pumping action urges any vapor entrained in the liquid fuel radially inwardly for venting at the vent passage.

In the preferred embodiment of the invention, the impeller has a circumferential rib that extends between and through adjacent vanes separating the axially adjacent pockets from each other, and the pumping channel has a circumferential rib that extends radially into the channel in opposed alignment with the impeller rib, preferably only in the high-pressure portion of the pumping channel. These opposed ribs enhance the vortex-like pumping action in the pumping channel by forming two pumping channels on opposed sides of the impeller. The impeller vanes in the preferred embodiment of the invention comprise so-called closed vanes, in which the bottom surface of each vane pocket formed in one axial face of the impeller is separated by the circumferential impeller rib from the bottom surface of the axially adjacent pocket on the opposing face of the impeller. The impeller pockets in the preferred embodiment of the invention are of curvilinear concave construction. The impeller side face channels open radially into the vane pockets at the radially innermost edge of the vane pockets, and at the circumferential edge of the vane pockets in the direction of impeller rotation. This pocket and channel geometry has been found to enhance vortex separation of fuel vapor from liquid fuel.

In accordance with another aspect of the present invention, the arcuate pumping channel in the pump mechanism is formed by a pair of plates that slidably engage opposed axial faces of the impeller, and a split ring that circumferentially surrounds the periphery of the impeller. The relaxed internal diameter of the split ring is less than the outer diameter of the impeller periphery so that, in assembly, the ring is expanded and elastic resiliency in the ring holds the ring in sliding engagement with the impeller until the ring is clamped in position. The gap between the circumferentially spaced ends of the split ring is disposed adjacent to the pumping channel outlet port and opens into the pump housing as does the outlet port, so that there is no loss of pumping efficiency due to the ring cap. This construction is not only more economical to assemble than are similar constructions in the prior art, but also provides improved performance repeatability in terms of fuel flow versus pump speed.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
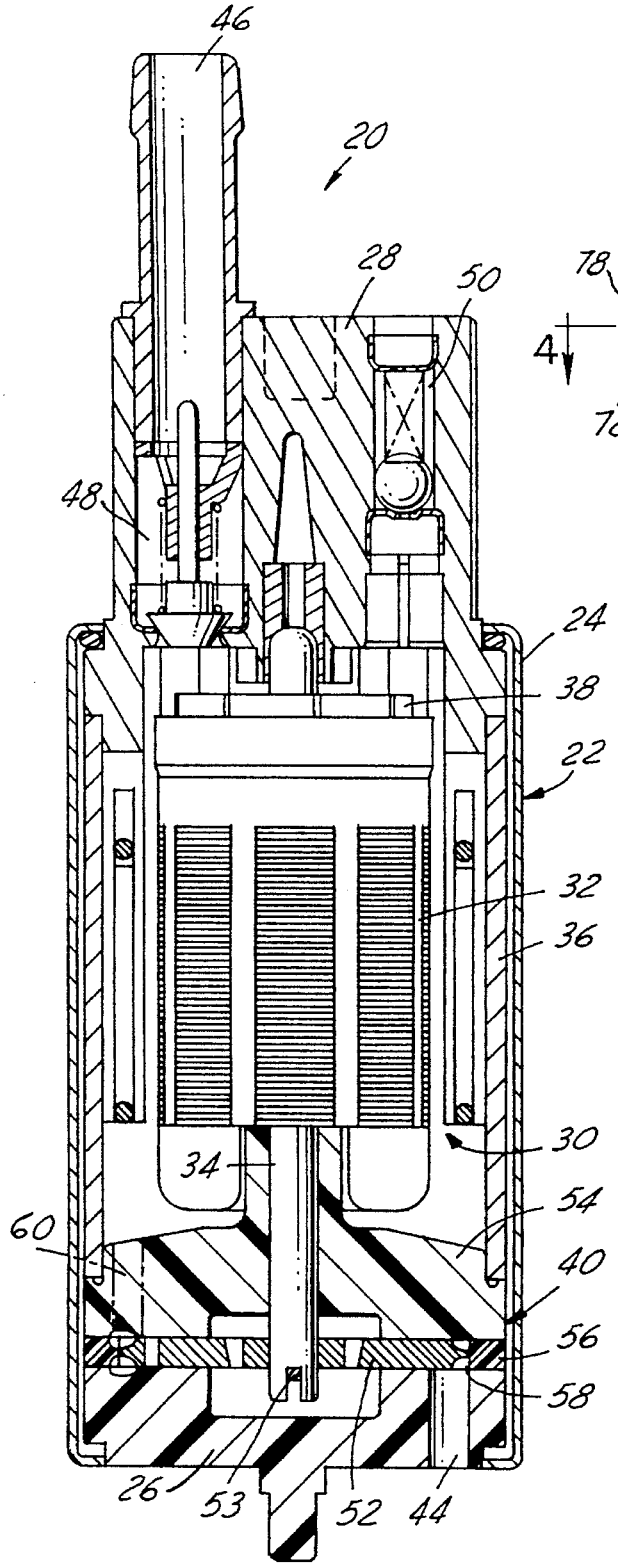
FIG. 1 is a sectional view in side elevation illustrating an electric-motor fuel pump in accordance with a presently preferred embodiment of the invention.
Figure 2:
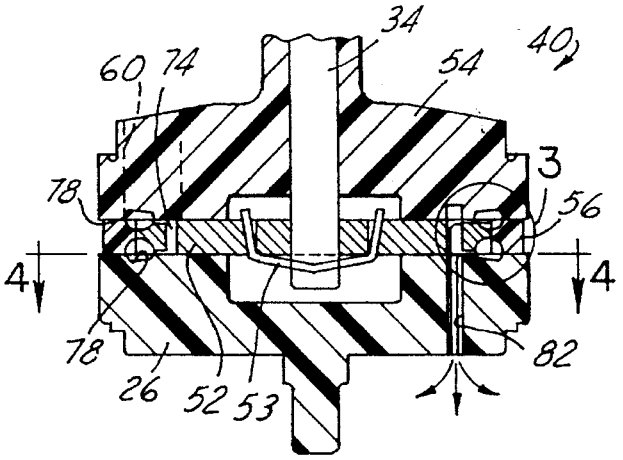
FIG. 2 is a fragmentary sectional view of the pump mechanism in the pump of FIG. 1.
Figure 3:
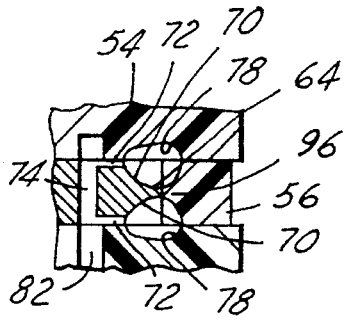
FIG. 3 is a fragmentary sectional view on an enlarged scale of the portion of FIG. 2 within the circle 3.

FIG. 1 illustrates an electric-motor fuel pump 20 in accordance with a presently preferred embodiment of the invention as comprising a housing 22 formed by a cylindrical case 24 that joins axially spaced inlet and outlet end caps 26, 28. An electric motor 30 is formed by a rotor 32 journalled by a shaft 34 for rotation within housing 22, and by a surrounding permanent magnet stator 36. Brushes (not shown) are disposed within outlet end cap 28 and electrically connected to terminals positioned of end cap 28. The brushes are urged into electrical sliding contact with a commutator plate 38 carried by rotor 32 and shaft 34 within housing 12. Rotor 32 is coupled to a pump mechanism 40 for pumping fuel from an inlet 44 (FIG. 4) through the pump mechanism into the interior of pump housing 22, and thence through an outlet 46 to the engine or other fuel consumer. A check valve 48 and a pressure relief valve 50 are also carried by outlet end cap 28. To the extent thus far described, pump 20 is generally similar to that disclosed in above-noted U.S. Pat. No. 5,257,916, the disclosure of which is incorporated herein by reference.

Pump mechanism 40 includes an impeller 52 coupled to shaft 34 by a wire clip 53 for corotation with the shaft. A pair of side plates are disposed on opposed axial sides of impeller 52, one side plate being provided by inlet end cap 26 and the other being provided by upper cap 54. Caps 26, 54 are mounted against rotation within housing 22 between stator 36 and case 24. A split ring 56 is sandwiched between caps 26, 54 surrounding the periphery of impeller 52. Plates 26, 54 and ring 56 thus form an arcuate pumping channel 58 extending around the periphery of impeller 52 from inlet port 44 in end cap 26 to outlet port 60 in cap 54.

Figure 5:
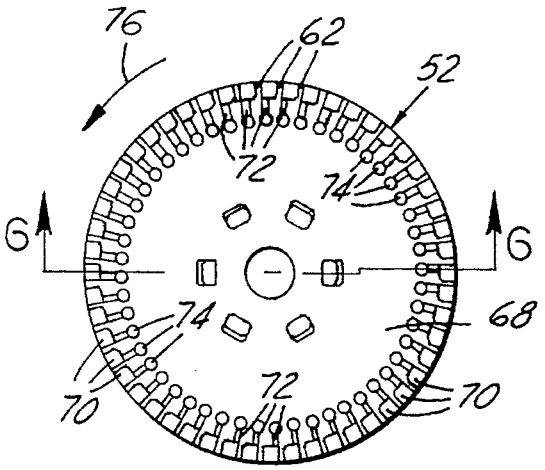
FIG. 5 is an elevational view of a pump impeller in accordance with a presently preferred embodiment of the invention.
Figure 6:
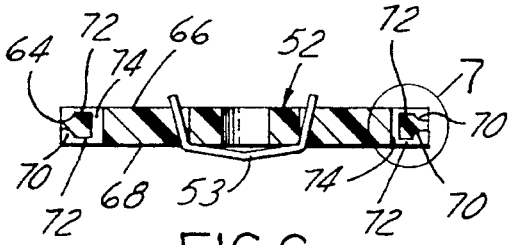
FIG. 6 is a sectional view taken substantially along the line 6—6 of FIG. 5.
Figure 7:
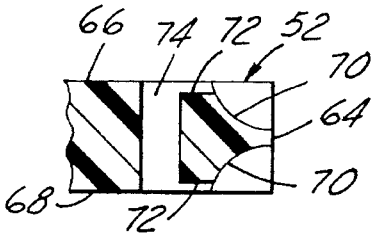
FIG. 7 is a fragmentary sectional view on an enlarged scale of the portion of FIG. 6 within the circle 7.

Impeller 52 is illustrated in greater detail in FIGS. 5–7. Impeller 52 has a circumferential array of angularly spaced radially and axially extending vanes 62 and a centered radially extending circumferentially continuous rib 64. Rib 64 is centered between the opposed axial faces 66, 68 of impeller 52, and cooperates with vanes 62 to form a circumferential array of equally spaced axially facing identical pockets 70 on opposed axial side faces 66, 68 of impeller 52. Each pocket 70 is of curvilinear concave construction, opening both axially and radially of the impeller. In the preferred embodiment of the invention illustrated in the drawings, the impeller vanes comprise so-called closed vanes in which the bottom surface of each vane pocket 70 formed in one axial face of the impeller does not intersect the bottom surface of the axially adjacent pocket in the opposing impeller face. The outer peripheries of vanes 62 and rib 64 are on a common cylinder of revolution concentric with impeller 52. However, so-called open vane constructions of the type disclosed in above-noted U.S. Pat. No. 5,257,916 may also be employed with some loss of pumping efficiency. Pockets 70 on impeller side faces 66,68 are aligned with each other. Staggered pockets may also be employed.

An axially open channel 72 extends radially inwardly in each impeller side face 66, 68 from the radially innermost edge of a corresponding vane pocket 70. Channels 72 thus collectively form a circumferential array of uniformly angularly spaced channels in each side face, with each extending radially inwardly in the impeller side face from a corresponding vane pocket, as shown in FIG. 5. Channels 72 preferably open into associated pockets 70 at the leading edge of each pocket, which is to say the edge of each pocket in the direction 76 (FIG. 5) of impeller rotation. FIG. 5 illustrates channels 72 on impeller side face 68, channels 72 on the opposing side face 66 being a mirror image thereof. An opening or passage 74 extends through impeller 52 between side faces 66, 68 so as to interconnect the radially inner ends of each axially aligned pair of channels 72. Thus, as shown in FIG. 5, there is provided a circumferential array of uniformly angularly spaced impeller through openings 74, each interconnecting a channel 72 on impeller side face 62 with the aligned channel 72 on impeller side face 68 radially inwardly of vane pockets 70. All through openings 74 are on a common radius from the center of impeller 68.

Figure 4:
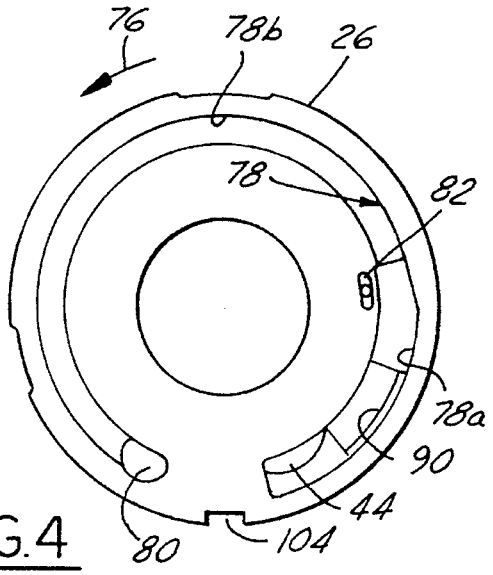
FIG. 4 is an elevational view of the inlet end cap taken substantially along the line 4—4 in FIG. 2.

Inlet end cap 26 (FIGS. 1–4) has axially oriented inlet port 44, as described above, that opens into an arcuate channel 78 that forms a portion of the pumping channel surrounding the periphery of impeller 52. The first angular portion **78*a* of channel 78 immediately adjacent to inlet port 44 is of greater radial dimension, and extends for about 90° around the axis of end cap 26. The remainder 78*b* of channel 78 in the direction 76 of impeller rotation is of lesser radial dimension, terminating at a shadow port 80 axially aligned with outlet port 60 in plate 54. Plate 54 has a channel 78 of essentially mirror image construction, with outlet port 60 opposed to shadow port 80 and a shadow inlet port opposed to inlet port 44. A vapor port 82 extends through inlet end cap 26. Port 82 is at a radius from the axis of end cap 26 for sequential registry with impeller passages 74 as impeller 52 rotates past the end cap. Angularly of inlet port 44, vapor vent passage 82 is disposed at the transition between portions 78*a*,78*b* of channel 78, as best seen in FIG. 4**.

Figure 8:
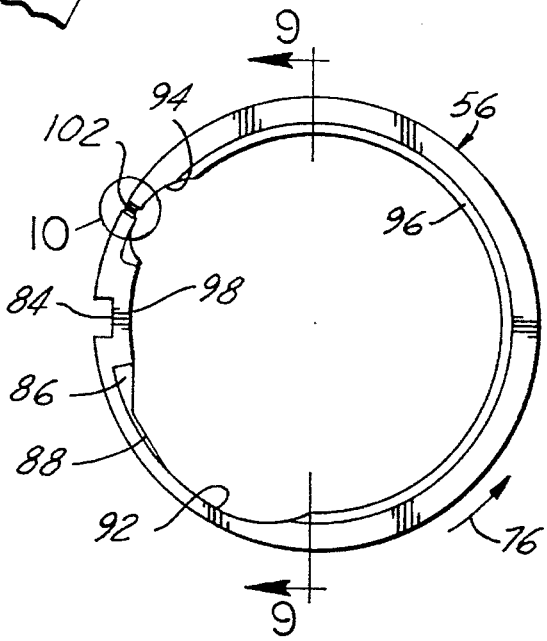
FIG. 8 is an elevational view of a channel ring in accordance with the presently preferred embodiment of the invention.
Figure 9:
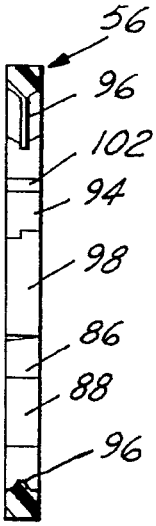
FIG. 9 is a sectional view taken substantially along the line 9—9 in FIG. 8.

Ring 56 is shown in FIGS. 8 and 9. Starting with alignment notch 84 in FIG. 9, and moving in direction 76 of impeller rotation, the radially inner surface of ring 56 first has a ramped area 86 that aligns with inlet port 44 in inlet cap 26, and then a stepped portion 88 that aligns with a ramped region 90 in channels 78 in both caps 26, 54. These ramped inlet regions provide improved and enhanced fuel transition from inlet 44 to the pumping channel surrounding impeller 52. The inner diameter of ring 56 then enters a region 92 of greatest radial dimension. From a position of about 90° from alignment notch 84 in direction 76, and continuing around the inner diameter of ring 56 to adjacent outlet cross passage 94, ring 56 has a centrally disposed radially inwardly extending rib 96. In assembly, rib 96 is axially aligned with and radially opposed to rib 64 of impeller 52. Thus, starting from a position about 90° from alignment notch 84, rib 96 of ring 56 and rib 64 of impeller 52 effectively divide the pumping channel into axially spaced separate pumping channels.

An enlarged cross passage 94 in the inner diameter of ring 56 aligns in assembly with shadow port 80 and outlet port 60. On the axially opposed sides of the pumping channel, cross passage 94 is of differing circumferential dimension, as best seen in FIGS. 8 and 9. This staggering of the exhaust cross passage has been found to provide noise reduction when employed with impellers in which the pockets 70 are axially aligned on the opposed sides of the impeller. Where the impeller pockets are circumferentially staggered on the axial impeller side faces, such staggered outlet porting is not as beneficial. From the staggered outlet cross passage, the inner diameter of ring 56 enters a transition region 98 disposed radially inwardly of alignment notch 84 for transition between the outlet and inlet ports. Transition region 98 and the inner diameter of rib 96 are on a common cylinder of revolution.

Figure 10:
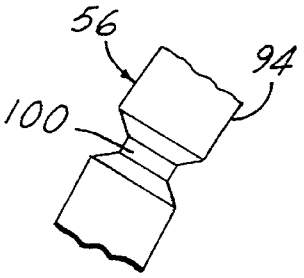
FIG. 10 is a fragmentary view on an enlarged scale of a portion of the ring in FIG. 8 within the circle 10 at an intermediate state of manufacture.

In construction of pump 20, ring 56 is initially formed as a single monolithic piece, with a reduced neck portion 100 (FIG. 10) within outlet cross passage portion 94. This neck 100 is then removed with a suitable tool so as to split the ring circumference and form the split or gap 102 (FIG. 8) where the circumferentially opposed ends of the split ring face each other. The inner diameter of ring 56, defined by the inner diameter of rib 96 and the inner diameter of transition region 98 on a common circle of revolution, is less than the outer diameter of impeller 52 at the periphery of rib 64. Cap plate 54 and impeller 52 are assembled to shaft 34 of rotor 32. Ring 56 is then assembled over the periphery of impeller 52 by expanding the ring circumferentially, placing the ring around the periphery of the impeller, and then releasing the ring so that inherent elasticity of ring 56 resiliently holds the ring in radial abutment with the outer periphery of the impeller. (Ring 56, plates 26,54 and impeller 52 preferably are all of corrosion-resistant plastic composition.) Alignment notch 84 in ring 56 is aligned with the corresponding notch (not shown) of plate 54. Inlet cap plate 26 is then assembled over ring 56 and impeller 52, with alignment notch 104 of plate 26 aligned with notch 84 of ring 56 and the corresponding notch of cap 54. Since, until this point, ring 56 is free to move laterally, ring 56 is essentially self-centering with respect to the periphery of impeller 52. When plates 26, 54 are then clamped to each other with ring 56 sandwiched therebetween, the ring is firmly clamped in this self-centered position. This split ring assembly technique has been found greatly to enhance pump-to-pump performance repeatability in terms of fuel flow versus pump speed. There is also a reduction in part and assembly cost as compared with conventional technology. It will be noted that gap 102 in ring 56 is at cross passage 94 and aligned with outlet port 60 in plate 54. Since any fluid flowing through gap 102 flows to the interior of case 22, which is at outlet pressure, there is no loss of pumping efficiency due to leakage of fluid through this gap.

In operation, pump 20 is placed in a fuel tank and electrical power is applied to the pump rotor. As the rotor rotates impeller 52 within pumping channel 58, liquid fuel is drawn through inlet 44 into the pumping channel, around the pumping channel and out under pressure through outlet 60. The vortex-like pumping action imparted to the liquid fuel by the impeller tends to separate any entrained vapor due to centrifugal forces imparted on the liquid fuel in the impeller pockets and pumping channel. These centrifugal forces tend to push the heavier liquid radially outwardly, which displaces the vapor radially inwardly along channels 72 in the impeller side faces, and thence to cross-passages 74. As each cross-passage 74 aligns with vent 82 in end cap 26, the fuel vapor is expelled under pressure back to the surrounding tank.

I claim:

1. An electric-motor fuel pump that comprises:

a housing including a fuel inlet and a fuel outlet, an electric motor including a rotor and means for applying electrical power to said motor to rotate said rotor within said housing, pump means including an impeller coupled to said rotor for corotation therewith and having a periphery with a circumferential array of vanes, and means forming an arcuate pumping channel surrounding said impeller periphery and coupled to said inlet and said outlet, said means forming said pumping channel including channel inlet and outlet ports at opposed ends of said pumping channel, said vanes comprising circumferential arrays of axially facing pockets on opposed axial side faces of said rotor, a channel extending radially inwardly from each pocket on each axial side face of said rotor, and a passage extending axially through said impeller radially inwardly of said pockets interconnecting said channels, and vent means in said pump means for sequential registry with said passages in said impeller as said impeller rotates to vent vapor from within said pockets and said pumping channel.

2. The pump set forth in claim 1 wherein said means forming said arcuate pumping channel includes a circumferential rib that extends radially into said channel opposed to said impeller periphery.

3. The pump set forth in claim 2 wherein said rib circumferentially extends part way around said pumping channel for less than the entire arcuate length of said pumping channel.

4. The pump set forth in claim 3 wherein said rib is disposed adjacent to said outlet port.

5. The pump set forth in claim 4 wherein said rib has an end spaced from said inlet port, and said vent means is disposed adjacent to said end of said rib.

6. The pump set forth in claim 2 wherein said impeller has a circumferential rib between adjacent vanes that separates axially adjacent pockets from each other, said rib in said pumping channel being radially opposed to said impeller rib and dividing said pumping channel into two separate pumping channels on opposed sides of said impeller.

7. The pump set forth in claim 6 wherein said outlet port includes a cross passage extending axially through said channel rib, said cross passage having a greater circumferential dimension on one side of said impeller than on the other.

8. The pump set forth in claim 6 wherein said means forming said arcuate pumping channel includes a split ring having said channel rib, said split ring having circumferentially opposed ends forming a gap disposed adjacent to said outlet port.

9. The pump set forth in claim 8 wherein said outlet port and said gap open into said housing.

10. The pump set forth in claim 1 wherein said impeller rotates in a predetermined direction, and where said channels open into said pockets at edges of said pockets in said predetermined direction of rotation of said impeller.

11. The pump set forth in claim 10 wherein each said pocket is of curvilinear arcuate construction, the channel associated with each said pocket opening into the radially innermost portion of said pocket.

12. The pump set forth in claim 11 wherein said vanes comprise closed vanes.

13. An electric-motor fuel pump that comprises:

a housing including a fuel inlet and a fuel outlet, an electric motor including a rotor and means for applying electrical power to said motor to rotate said rotor within said housing, and pump means including an impeller coupled to said rotor and having a periphery with a circumferential array of vanes, and means forming an arcuate pumping channel surrounding said impeller periphery, said means forming said arcuate pumping channel comprising a pair of plate means opposing respective side faces of said impeller, channel inlet and outlet means in said plate means at opposed ends of said arcuate pumping channel, and a split channel ring disposed between said plate means radially surrounding said periphery of said impeller, said split ring having circumferentially opposed ends spaced from each other and forming a gap therebetween.

14. The pump set forth in claim 13 wherein said impeller has a circumferential rib between adjacent vanes, and where said ring has a circumferential rib that extends radially into said channel, said ring rib being in sliding engagement with said impeller rib.

15. The pump set forth in claim 14 wherein said gap is disposed adjacent to said outlet port.

16. The pump set forth in claim 15 wherein both said gap and said outlet port open into said housing.

* * * * *